US006190251B1

(12) United States Patent
Park

(10) Patent No.: US 6,190,251 B1
(45) Date of Patent: Feb. 20, 2001

(54) VENTILATOR FOR EASY ASSEMBLY AND IMPROVED EXHAUST OF INDOOR AIR

(76) Inventor: Tai Up Park, Yang Chun Gu, Mok Dong 125, Apt. 507, Seoul (KR)

( * ) Notice: Under 35 U.S.C. 154(b), the term of this patent shall be extended for 0 days.

(21) Appl. No.: 09/266,377

(22) Filed: Mar. 11, 1999

(30) Foreign Application Priority Data

Aug. 11, 1998 (KR) ..... 98-15066

(51) Int. Cl.[7] ..... F23L 17/02
(52) U.S. Cl. ..... 454/35; 454/42; 454/367
(58) Field of Search ..... 454/367, 366, 454/368, 33, 38, 39, 42

(56) References Cited

U.S. PATENT DOCUMENTS

| | | | | |
|---|---|---|---|---|
| 2,830,526 | * | 4/1958 | Breidert | 454/33 |
| 3,049,068 | * | 8/1962 | Rousey | 454/33 |
| 3,064,638 | * | 11/1962 | Bauer | 454/35 |
| 4,638,727 | * | 1/1987 | Mitchell | 454/33 |
| 5,655,964 | * | 8/1997 | Rheault | 454/368 |

FOREIGN PATENT DOCUMENTS 101095 3/1990 (KR) .

* cited by examiner

*Primary Examiner*—Pamela Wilson
*Assistant Examiner*—Michelle A Mattera
(74) *Attorney, Agent, or Firm*—Oppenheimer Wolff Donnelly LLP

(57) ABSTRACT

The fixed type ventilator according to the present invention includes: a support at the base with openings at the top and bottom; a first air current guide plate with an inclined surface with an angle of inclination of approximately 120° to 130°, which has an opening therethrough, and is coupled over the support; a second air current guide plate, with an inclined surface with an angle of inclination of approximately 120° to 130°, is coupled over the first air current guide plate with a gap of approximately 5 to 10 cm between the second air current guide plate and the inclined enclosed surface of the first air current guide plate. An air passage for the indoor air is provide through the bottom opening of the support and the gap, and natural outdoor air is allowed to flow therethrough the gap of the ventilator.

16 Claims, 3 Drawing Sheets

VENTILATOR FOR EASY ASSEMBLY AND IMPROVED EXHAUST OF INDOOR AIR

REFERENCE TO RELATED APPLICATION

This application claims the foreign priority filing date of Aug. 8, 1998, based on an application for patent filed in South Korea on that date with an assigned application number of 1998-15066.

BACKGROUND OF THE INVENTION

1. Field of Invention

This invention relates generally to a fixed type ventilator and, more particularly, a ventilator that is easy to assemble and with an improved performance of exhausting indoor air.

2. Description of the Related Art

Conventional fixed type ventilators generally include an upper extension part in shape of a disk with its center hollow, and a lower part with horizontal extension for fixing bolts and several plates that are layered one after another for its installation. There are, however, several problems with the conventional ventilators as described above. One such problem is that the metal support pipe at the bottom of the fixed hole of each air current guide plate must be made in one unit, resulting in a complex ventilator structure, because the support and the supporting device must have a respective round frame and a connection piece in the horizontal direction. Another problem is that the angle of inclination of the main wall of each air current guide plate is too vertical, which fails to induce stable flow of air current, thereby causing poor ventilation of indoor air. At the same time, modifying the inclination of the main wall by trial and error is ineffective, because there is a lack of a reference figure to improve the ventilation rate of indoor air.

Therefore, there is a need to change the above mentioned connection structure of air current guide plates into a more simple assembly structure while at the same time, optimizing the structure of the air current guide plate by means of accurate data on inclination angle of the inclination main wall to improve the exhaustion of indoor air.

In light of the above mentioned problems with the conventional air current guide plate, there is a need for a fixed type ventilator with improved exhaustion performance by optimizing the inclination angle of the main wall. There is further a need to simplify the connection and assembly structure of air current guide plate for easy installation.

OBJECT AND SUMMARY OF THE INVENTION

One of the objective of the present invention is to provide an improved fixed type ventilator that exhausts greater volume of indoor air, and is easy to assemble and install.

In accordance with one aspect of the present invention, these and other objectives are accomplished by providing a fixed type ventilator comprised of a second air current guide plate (300), which is located at the top of the uppermost layer of a plurality of first air current guide plates (200). The plates (200) and (300) are assembled by connecting means (400). The first air current guide plate (200) has a horizontally extended part (230) with fixed holes (210), and an inclined main wall (240) defining an opening (220) at the top of the plate (200). The second air current guide plate (300) has an inclined main wall (350) with a horizontal extension plate (340) at the base of the wall (350), and a blocking plate (330) to cover the wall (350). The second air current guide plate (300) prevents penetration of rainwater and guides inflow of air current.

This invention with its simple structure saves cost in manufacturing and installation, and improves the volume of exhaust of indoor air by natural air current.

BRIEF DESCRIPTION OF THE DRAWINGS

Detailed description of the preferred embodiment of the invention will be made with reference to the accompanying drawings.

DETAILED DESCRIPTION OF THE PREFERRED EMBODIMENT

The following is a detailed description of the best presently known mode of carrying out the invention. This description is not to be taken in a limiting sense, but is made merely for the purpose of illustrating the general principles of the invention. The scope of the invention is defined solely by the appended claims.

One of the objectives of the present invention is achieved by a fixed type ventilator that is mounted upon an upper extension part of support one by one. The upper part forms an opening and the lower part is open toward the bottom. A first air current guide plate creates an inclination main wall in between said opening and horizontal extension part. A second air current guide plate is located at the uppermost layer of the first air current guide plate and its upper part forms a blocking plate. The lower bottom is open, thus forming a horizontal extension plate. In between said blocking plate and horizontal extension plate inclination a main wall formed. Several supporting devices are installed along the support and main walls. Supporting pipes are located in between fixed holes at the time of mounting the first air current guide plate and second air current guide plate. The support is inserted into said support pipe, long bolt, washer and nut for mounting said first and second air current guide plate one by one.

Figure 1:
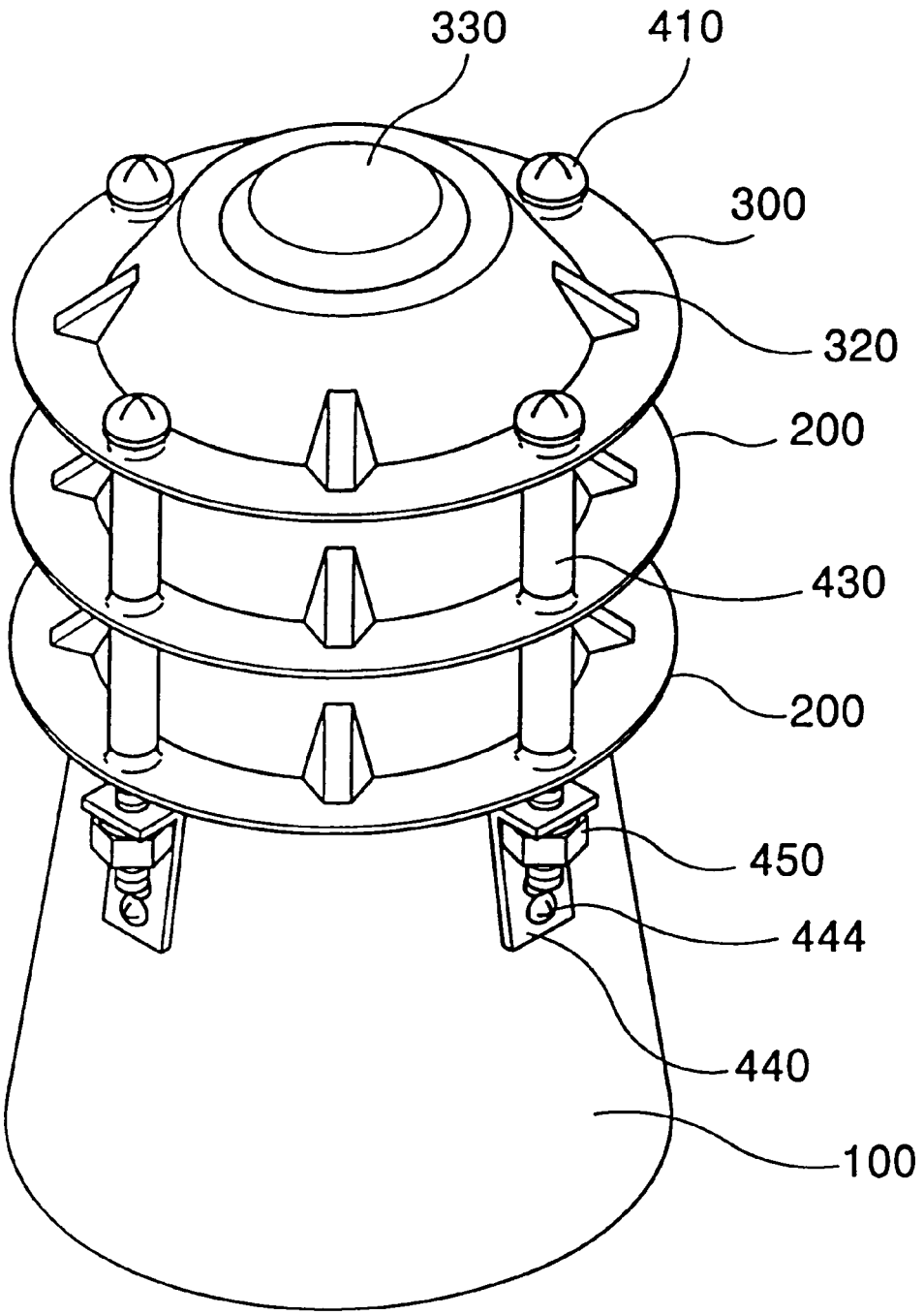
FIG. 1 is perspective view of one embodiment of the present invention.
Figure 3:
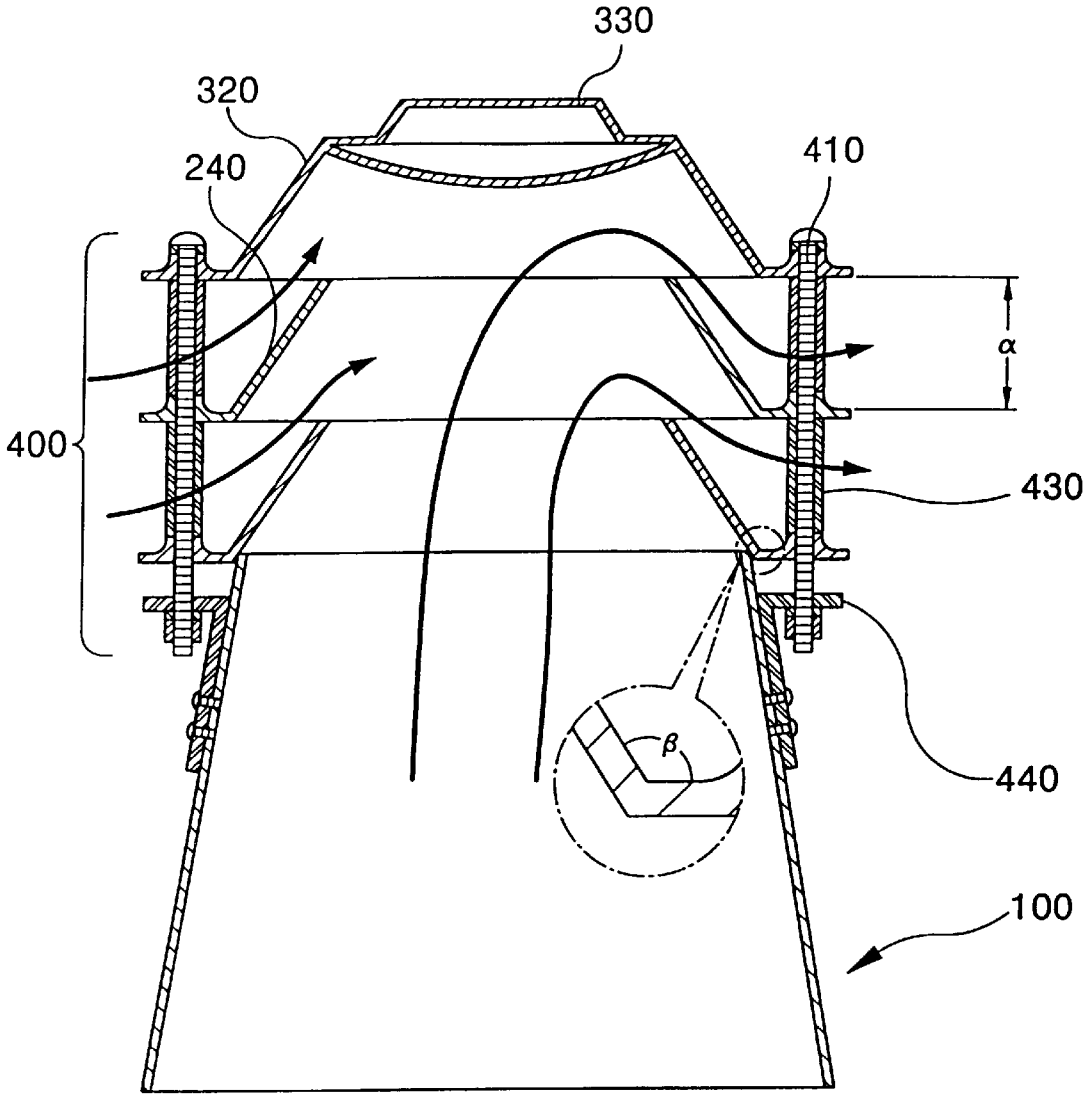
FIG. 3 is a cross-sectional view of the one embodiment of the present invention.

As illustrated by way of example in FIG. 1, a ventilator in accordance with one embodiment of the present invention includes a support (100), at least one first air current guide plate (200), and a second air current guide plate (300), all coupled respectively by connection means (400), as illustrated by way of example in FIG. 3.

Figure 2:
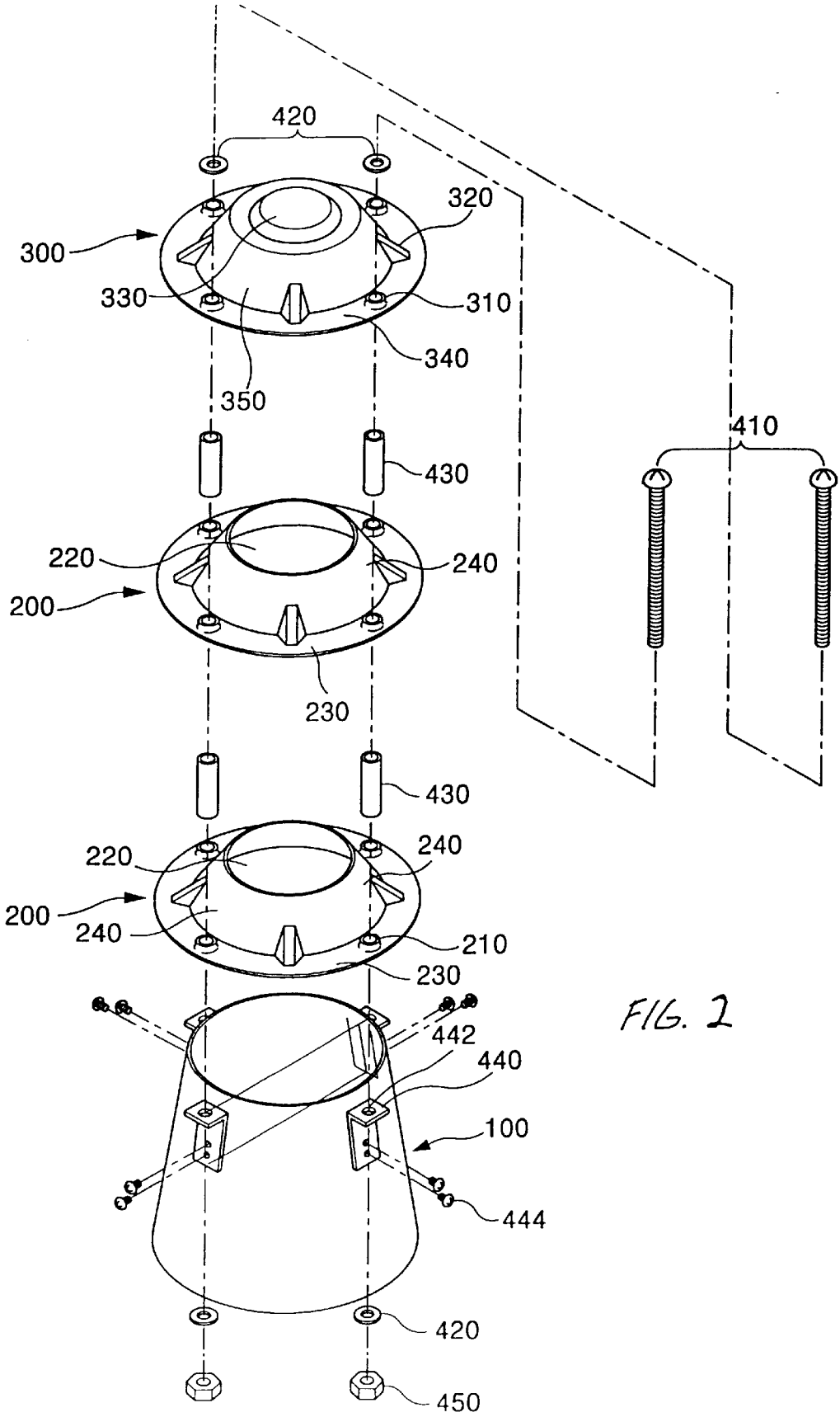
FIG. 2 is an exploded perspective view of the one embodiment of the present invention.

As illustrated by way of example in FIG. 2, one of the air current guide plates (200) is mounted on the upper extension of the support (100), one at a time. The upper part of the plate (200) forms an opening (220), and the lower part opens toward the bottom, and forming a horizontal extension (230). The extension (230) has holes (210) and in between the opening (220) and the horizontal fixed extension (230) forms an inclination main wall (240).

The second air current guide plate (300) is located at the uppermost layer of the first air current guide plate (200). Furthermore, the upper part of the plate (300) forms a blocking plate (330), and the lower bottom is open to form a horizontal extension plate (340) which has fixed openings (310). Between the blocking plate (330) and the horizontal extension plate (340) forms an inclination main wall (350).

Connection means (400), as shown in FIGS. 2 and 3, include a plurality of support devices (440) installed along the main wall of the support (100), a plurality of support pipes (430) located in between fixed holes (210) (310), and washers (420) and long bolts (410) to hold the assembly together. In this regard, FIG. 2 shows exploded view of the exemplary embodiment of the present invention; and FIG. 3 shows by way of example, the exemplary embodiment assembled through the connection means (400). FIG. 3, also show the slanted angle β, which indicates the slanted angle of the inclination main wall (240). Also, inverted "L" supports (440) are coupled to the support (100) via two bolts (444), where holes (442) are now fixed to the support (100) to receive the long bolts (410).

The exemplary embodiment is assembled by positioning the first air current guide plate (200) above the support (100). Then the support pipes (430) are inserted into the four fixed holes (210) so that the first air current guide plate (200) may be mounted to the support (100) through the support pipes (430).

It is desirable to mount the air current guide plate (200) in two layers, which increases the power of exhaustion due to the increase in total diameter. In other words, increasing the number of layers increases the power of exhaustion. To mount two layers of the first air current guide plate (200), the four fixed holes (210) of each of the layers (200) are respectively aligned with the support pipes (430). Thereafter, the second air current guide plate (300) is positioned over the uppermost layer of the first air current guide (200), so that the fixed holes (310) are aligned with the fixed holes (210), along with the support pipes (430) aligned therebetween the fixed holes (310) and (210). FIG. 1, shows the exemplary embodiment assembled through the connection means (400).

To hold the ventilator assembly together, long bolts (410) are used. For example, a bolt (410) may be inserted into the assembly in the following sequence: a washer (420), the fixed hole (310), the support pipe (430), fixed hole (210), washer (420) and finally at the support device (440) of the support (100) a nut (450) with a washer (420) is placed and fixed.

Accordingly, with the present invention, defects which occurred during the installation of conventional ventilators by fixing support pipe to lower part of the air current guide plate is eliminated. Also, the cost of manufacturing the fixed type ventilator as described in the present invention is lower than the conventional ventilators, and easier to install.

A Ventilator in accordance with the present invention in finished condition is installed to an air exhaust device and causes the indoor air to be naturally ventilated.

In particular, as illustrated by way of example in FIG. 3, the exemplary embodiment of the present invention, provides the inclination main walls (240) (350) of the first and second air current guide plates (200) (300) to facilitate natural flow of air current and an accurate angle of inclination to improve the volume of exhaust.

In short, indoor air current is exhausted by inducing essentially stable natural outdoor air current through the guide plates (200) (300) of the ventilator, and by means of induced exhaust pressure of the indoor air current ventilating through the inclination wall (240) with the most optimal inclination angle, which is displayed in Table 1.

In the following Table 1, α indicates height of inclination wall, β indicates inclination angle, and unit of resulting value under various condition shows volume of exhaust air per second in $cm^3/s$ (cubic centimeters per second).

As shown in Table 1, the highest volume of exhaust is exhibited (2.5 $cm^3/s$) when the height from top to bottom (α) is about 7 cm and β (inclination angle) is between 120°–125°, for the inclination main walls of the air current guide plates (200) (300).

Accordingly, this invention eliminates the problem of low volume of exhaust due to air current guide plates being too vertical or not being set at proper inclination angle. The problem is resolved by setting a more accurate inclination angle for air current guide plate to induce most optimal exhaustion of indoor air, and a heighten gap between the inclination main walls (240) (350) to optimize the flow of inflowing air current and indoor air exhaust volume. At the same time, this invention through its simple design minimizes the cost of manufacturing, installation, and facilitating a quicker and robust operation of ventilator.

TABLE 1

| | β | | | | | | | |
|---|---|---|---|---|---|---|---|---|
| α | 40° | 60° | 105° | 115° | 120° | 125° | 130° | 150° |
| 3 cm | 0.7 | 0.7 | 1.1 | 1.15 | 1.3 | 1. | 1.15 | 1.1 |
| 5 cm | 0.8 | 0.9 | 1.3 | 1.5 | 2.1 | 2.1 | 1.7 | 1.2 |
| 7 cm | 0.9 | 1.00 | 1.00 | 1.9 | 2.5 | 2.5 | 2.2 | 1.7 |
| 10 cm | 0.8 | 0.9 | 0.9 | 1.6 | 2.2 | 2.2 | 1.7 | 1.5 |

Although the present invention has been described in terms of the preferred embodiment above, numerous modifications and/or additions to the above-described preferred embodiments would be readily apparent to one skilled in the art.

It is intended that the scope of the present invention extends to all such modifications and/or additions and that the scope of the present invention is limited solely by the claims set forth below. With respect to the claims, it is applicant's intention that the claims not be interpreted in accordance with the sixth paragraph of 35 U.S.C. § 112 unless the term "means" is used followed by a functional statement.

What is claimed is:

1. A ventilator assembly comprising:

a support having a first and a second opening;

a first air current guide plate having a straight inclined surface and having a first opening and a second opening, the width of the first opening being less than the width of the second opening, wherein the second opening of the first air current guide plate is adapted to couple to the first opening of the support;

a second air current guide plate having an opening, the width of the opening of the second air current guide plate being greater than the width of the first opening of the first air current guide plate;

a spacer between the first and second air current guide plates to provide a gap between the opening of the second air current guide plate and the straight inclined surface of the first air current guide plate; and a connector adapted to connect the first air current guide plate to the support, and to connect the spacer to the first and second air current guide plates;

wherein the straight inclined surface of the first air current guide plate has an angle of inclination between about 120° and about 130 °, and the gap between the opening side of the second air current guide plate and the straight inclined surface of the first air current guide plate is about 5 cm to about 10 cm.

2. The ventilator assembly according to claim 1, wherein the straight inclined surface of the first air current guide plate has an angle of inclination between approximately 120° and 125°, and the gap between the opening side of the second air current guide plate and the straight inclined surface of the first air current guide plate is about 7 cm.

3. The ventilator assembly according to claim 1, wherein the first air current guide plate has a height approximately equal to the length of the spacer.

4. The ventilator assembly according to claim 1, wherein the first air current guide plate is circular.

5. The ventilator assembly according to claim 1, further including at least one additional first air current guide plate having an inclined surface and having a first opening and a second opening, the width of the opening being less than the width of the second opening, wherein the second opening of the first air current guide plate is adapted to couple to the support at first opening.

6. A ventilator assembly comprising:

a first element having a first straight inclined surface between a first opening and a second opening, the diameter of the first opening being less than the diameter of the second opening, wherein the first straight inclined surface has an angle of inclination of about 120° to about 130°; and a second element having a second straight inclined surface and an opening, the diameter of the opening of the second element being greater than diameter of the second opening of the first element, wherein the second straight inclined surface has a straight angle of inclination substantially similar to the angle of inclination of the first straight inclined surface;

wherein the first element is adapted to be connected with the second element to form about a 7 cm gap between the first and second elements in such a manner that air flowing through the first and second openings of the first element also passes across the opening of the second element.

7. The ventilator assembly of claim 6, wherein the first opening of the first element forms an edge and wherein the second opening of the second element also forms an edge.

8. The ventilator assembly of claim 6, wherein the first and second openings of the first element are circular.

9. The ventilator assembly of claim 6, wherein the opening of the second element is circular.

10. The ventilator assembly of claim 6, further including a spacer to provide the gap.

11. The ventilator assembly of claim 6, further including a connector that is adapted to connect together the first and second elements.

12. The ventilator assembly of claim 6, further including a support element, wherein the support element has a first and second opening, the support element being adapted to connect to the first element at its second opening.

13. The ventilator assembly of claim 6, further including a third element, the third element having a first opening and a second opening, the diameter of the first opening being less than the diameter of the second opening, wherein the third element has a third straight inclined surface between the first and second openings of the third element, the third straight inclined surface having an angle of inclination that is substantially similar to the angle of inclination of the first straight inclined surface.

14. A method for ventilating a defined area, the method comprising the steps of:

providing a first air current guide element having a first surface between a first opening and a second opening, the first opening being smaller than the second opening, wherein the first surface has a straight angle of inclination of about 120° to about 130°;

providing a second air current guide element having a second surface with an opening, the opening of the second air current guide element being greater than the first opening of the first air current guide element, wherein the second surface has a straight angle of inclination substantially similar to the angle of inclination of the first surface, and a support pipe;

positioning the opening of the second air current guide element towards the first opening of the first air current guide element;

placing the support pipe between the first air current guide element and the second air current guide element, wherein the support pipe is about 5 cm to about 10 cm long to form a gap between the first and second air current guide elements; and coupling the second air current guide element to the first air current guide element.

15. The method according to claim 14, further comprising the steps of:

providing a support having a surface between a first opening and a second opening; and coupling the second opening of the first air current guide element to the first opening of the support.

16. The method according to claim 15 further comprising the steps of:

providing an air supply opening; and coupling the second opening of the support to the air supply opening.

* * * * *